US007577270B2

(12) United States Patent
Horigome et al.

(10) Patent No.: US 7,577,270 B2
(45) Date of Patent: Aug. 18, 2009

(54) DOME-SHAPED DIAPHRAGM AND SPEAKER

(75) Inventors: Minoru Horigome, Yamagata (JP); Hiroshi Sato, Yamagata (JP)

(73) Assignees: Pioneer Corporation, Tokyo (JP); Tohoku Pioneer Electronic Corporation, Yamagata (JP)

( * ) Notice: Subject to any disclaimer, the term of this patent is extended or adjusted under 35 U.S.C. 154(b) by 805 days.

(21) Appl. No.: 11/130,249

(22) Filed: May 17, 2005

(65) Prior Publication Data

US 2005/0259843 A1 Nov. 24, 2005

(30) Foreign Application Priority Data

May 18, 2004 (JP) ..... P2004-148384

(51) Int. Cl.
*H04R 1/00* (2006.01)
*H04R 9/06* (2006.01)
*H04R 11/02* (2006.01)

(52) U.S. Cl. ..... 381/430; 381/423

(58) Field of Classification Search ..... 381/430
See application file for complete search history.

(56) References Cited

U.S. PATENT DOCUMENTS 3,513,270 A * 5/1970 Warning ..... 381/424
6,154,556 A * 11/2000 Takahashi et al. ..... 381/430
6,320,972 B1 * 11/2001 Goller ..... 381/430

FOREIGN PATENT DOCUMENTS

JP 55-150581 U 10/1980
JP 2002-32790 A 1/2003

OTHER PUBLICATIONS

Japanese Notification of Reason for Refusal dated Apr. 28, 2009, English language Translation.

* cited by examiner

*Primary Examiner*—Brian Ensey
*Assistant Examiner*—Matthew Eason
(74) *Attorney, Agent, or Firm*—Sughrue Mion, PLLC

(57) ABSTRACT

A dome-shaped diaphragm includes a dome part which is formed in a dome-like shape and is convex forward in an oscillating direction, a neck part which is provided in continuation to an outer periphery of the dome part, and an edge including a roll part which is formed in a curved shape and is convex forward in the oscillating direction, and continued to the neck part at an inner peripheral edge thereof, wherein the neck part is provided with a curved portion which is convex backward in the oscillating direction, and an outer periphery of the curved portion is smoothly continued to an inner periphery of the roll part.

6 Claims, 2 Drawing Sheets

DOME-SHAPED DIAPHRAGM AND SPEAKER

The present disclosure relates to the subject matter contained in Japanese Patent Application No. 2004-148384 filed on May 18, 2004, which is incorporated herein by reference in its entirety.

BACKGROUND OF THE INVENTION

1. Field of the Invention

The present invention relates to a dome-shaped diaphragm including a dome part which is convex forward in an oscillating direction and has a neck part at an outer peripheral part thereof, and an edge part having a roll part which is convex forward in the oscillating direction and is provided in continuation to the neck part, and more particularly, to an improvement for enhancing rigidity of the edge part by increasing a rising height of the roll part without sacrificing acoustic characteristics.

2. Description of the Related Art

FIG. 1 shows a structure of a dome-shaped speaker unit in which a dome-shaped diaphragm is employed.

This speaker unit 1 includes a magnetic circuit 3, a speaker frame 5 having this magnetic circuit 3 attached to a rear part thereof, a dome-shaped diaphragm 7 having an edge 9 continuously provided at an outer peripheral part thereof, and a voice coil 12 which is wound around a voice coil bobbin 11 in a cylindrical shape.

The magnetic circuit 3 includes a yoke 15 having a center pole 15*b* in a cylindrical shape which is projected from a center part of a disc-shaped plate 15*a*, a magnet 16 in a ring-like shape which is loosely fitted to an outer periphery of the center pole 15*b*, and a top plate 17 in a ring-like shape which is loosely fitted to a distal end area of the center pole 15*b* in such a manner that the magnet 16 is interposed between the top plate 17 and the plate 15*a*.

A magnetic gap 19 for disposing the voice coil 12 is formed between an inner periphery of the top plate 17 and the center pole 15*b*.

The dome-shaped diaphragm 7 has a dome part 7*a* in a dome-like shape which is convex forward in an oscillating direction (i.e., the forward direction of sound travel when emitted from a speaker), a neck part 7*b* which is provided in continuation to an outer peripheral part of this dome part 7*a* for permitting the voice coil bobbin 11 to be fixed thereto, and the edge 9 having a roll part 9*a* in a curved shape which is convex forward in the oscillating direction. An inner peripheral edge of the roll part 9*a* is connected to the neck part 7*b*.

A flange part 9*b* is extended from an outer peripheral part of the edge 9. This flange part 9*b* is fixed to an edge supporting part 5*a* in the front of the speaker frame 5, in a state held between the edge supporting part 5*a* and a ring-shaped gasket 21 which is attached to the edge supporting part 5*a*.

In the related-art dome-shaped diaphragm 7, the neck part 7*b* is generally in a shape of a straight tube having a short length, so that a distal end of the voice coil bobbin 11 can be engaged with the neck part 7*b*. A connecting portion between this neck part 7*b* and the inner peripheral edge of the roll part 9*a* is formed as a bent part, as shown in FIG. 1, which is bent at an acute angle θ (Refer to JP-A-2003-32790, for example).

SUMMARY OF THE INVENTION

By the way, as a home theater system and so on has become popular, max power input of the speaker unit has been required to be enhanced, in order to realize reproduction of stentorian sounds with high grade.

For the purpose of enhancing the max power input, it is indispensable to enhance rigidity of the edge that permits oscillation of the diaphragm.

In the above-described dome-shaped diaphragm 7, it would be effective, for enhancing the rigidity of the edge 9, to erect an inclination of the inner peripheral part of the edge 9 toward the dome part 7*a* thereby to make an inclination angle α of the inner peripheral part of the edge 9 larger.

However, in the related-art dome-shaped diaphragm 7, when the inclination angle α of the inner peripheral edge of the edge 9 is made larger, an apex 9*c* of the roll part 9*a* is projected forward in the oscillating direction of the diaphragm, as shown by a phantom line in FIG. 1. Accordingly, a projecting height of the apex 9*c* of the roll part 9*a* is increased by a height h1, so that the apex 9*c* of the roll part 9*a* may be positioned at substantially the same level as an apex 7*c* of the dome part 7*a*.

In such a structure of the diaphragm in which the height of the roll part 9*a* is increased with respect to the dome part 7*a*, as described above, there arises a problem that a sound emitted from the dome part 7*a* interferes with the roll part 9*a*, and acoustic characteristics are liable to be disturbed.

Moreover, in the related-art dome-shaped diaphragm 7, because the connecting portion between the neck part 7*b* at the outer peripheral part of the dome part 7*a* and the inner peripheral part of the roll part 9*a* is formed as the bent part at an acute angle, performing stabilized molding is difficult, and at the same time, concentration of stress is likely to occur when the dome part 7*a* oscillates. Moreover, in case where the inclination of the inner peripheral part of the edge 9 is erected for the purpose of enhancing the rigidity of the edge 9, the connecting portion between the neck part 7*b* and the roll part 9*a* is formed as a more acutely bent structure. Consequently, there is such anxiety that yield of the products may be lowered because pin holes may be generated due to deterioration of molding performance, or durability may be decreased because rupture becomes likely to occur due to concentration of stress.

As the problems to be solved by this invention, there is a problem, which has happened in the above-described related art, that in case where the inclination of the inner peripheral part of the edge is erected for the purpose of enhancing the rigidity of the edge, the apex of the roll part of the edge is positioned at substantially the same level as the apex of the dome part, and sounds emitted from the dome part may interfere with the roll part, resulting in disturbance of the acoustic characteristics. There is another problem that the connecting portion between the neck part and the roll part is formed as a more acutely bent structure, and defects such as pin holes and ruptures may become likely to occur.

According to an aspect of the invention, there is provided a dome-shaped diaphragm including: a dome part which is formed in a dome-like shape and is convex forward in an oscillating direction; a neck part connected to an outer periphery of the dome part for fixing a voice coil bobbin thereto; and an edge including a roll part which is formed in a curved shape, convex forward in the oscillating direction, and continued to the neck part at an inner peripheral edge thereof, and a flange part which is provided at an outer peripheral edge of the roll part to be fixed to a speaker frame; wherein the neck part is provided with a curved portion which is convex backward in the oscillating direction, and an outer periphery of the curved portion is continued to an inner periphery of the roll part.

DETAILED DESCRIPTION OF THE PREFERRED EMBODIMENTS

Figure 1:
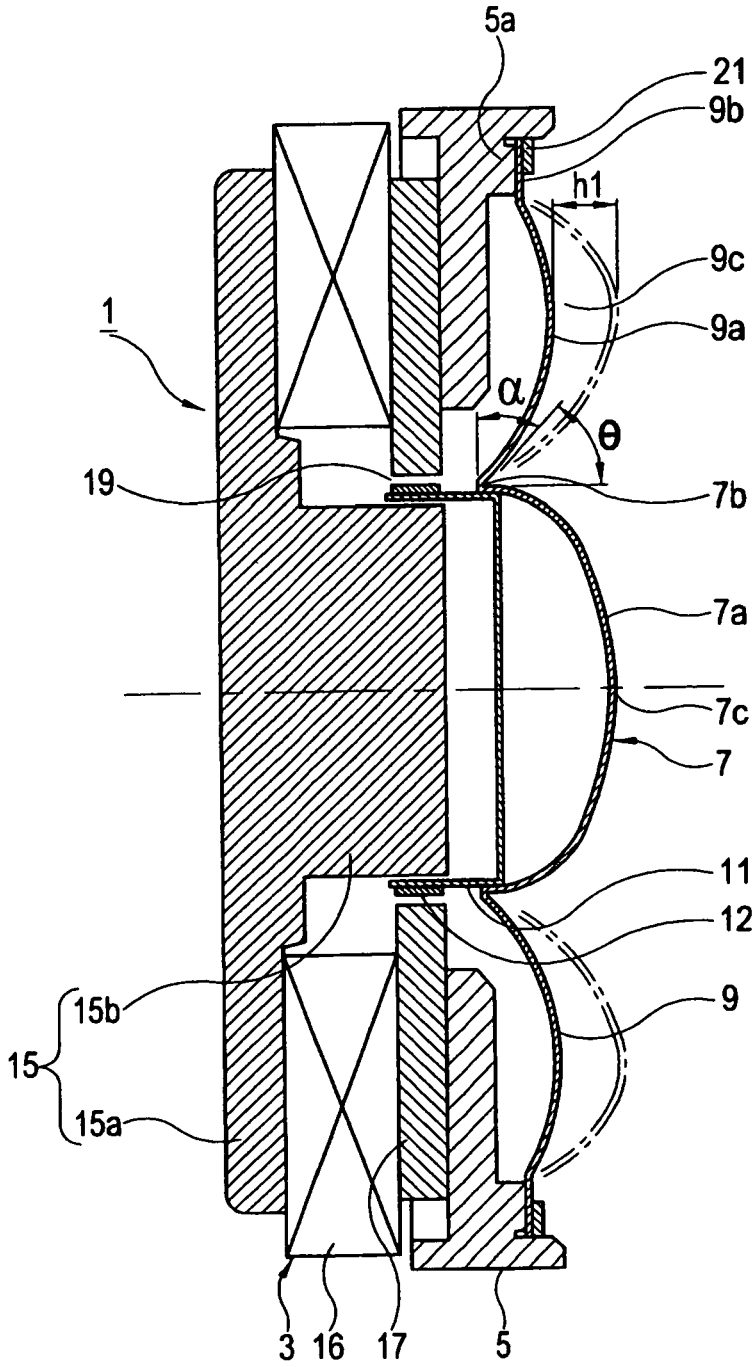
FIG. 1 RELATED ART
FIG. 1 is a vertical sectional view of a speaker unit in which a dome-shaped diaphragm in the related art is employed, showing the diaphragm of an acoustic transducer.

Now, a preferred embodiment of a dome-shaped diaphragm according to the invention will be described in detail, referring to the drawing.

Figure 2:
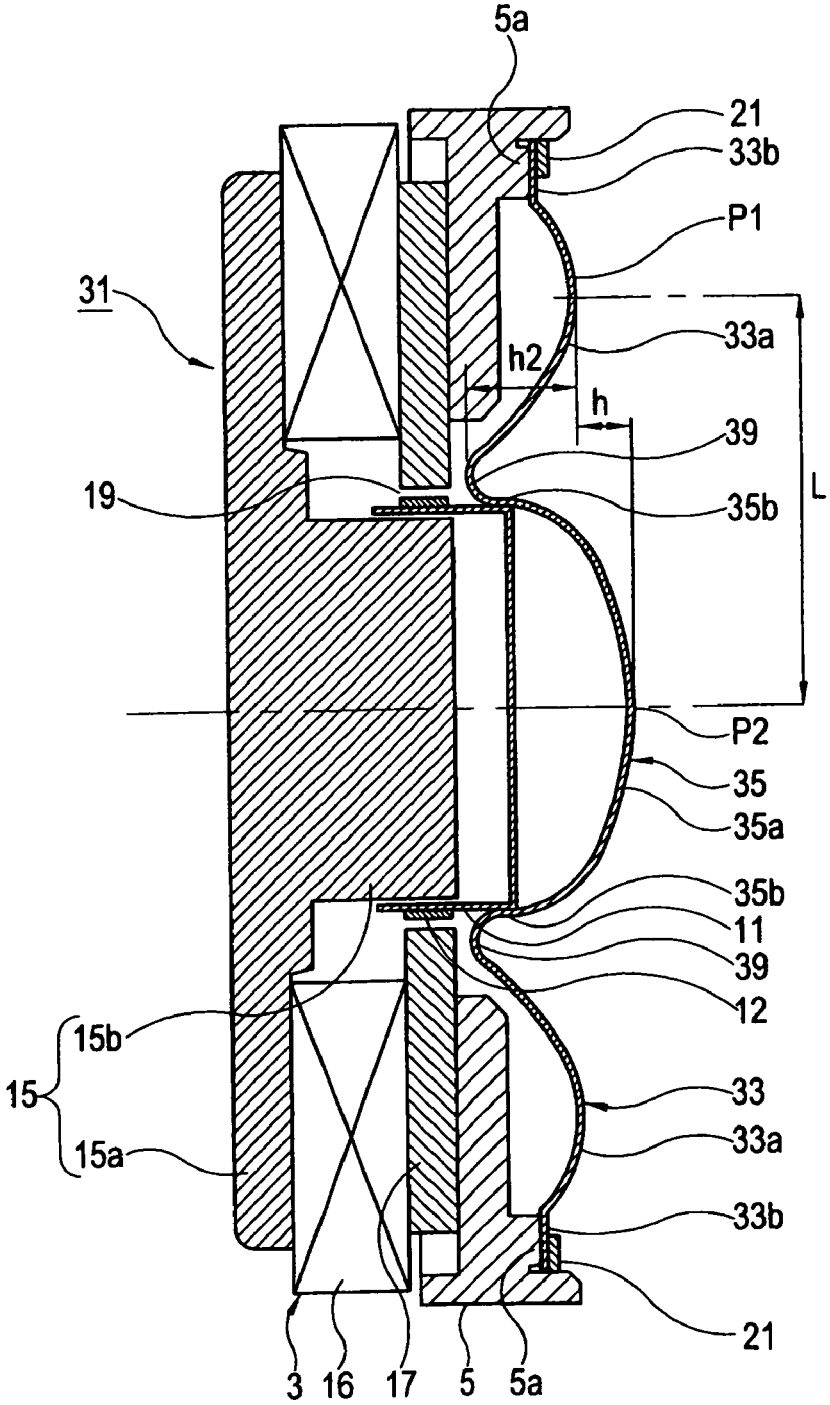
FIG. 2 is a vertical sectional view of an embodiment of a speaker unit in which a dome-shaped diaphragm according to of the invention is employed.

FIG. 2 is a vertical sectional view of an embodiment of a dome-shaped speaker unit in which the dome-shaped diaphragm according to the invention is employed.

This speaker unit 31 includes a magnetic circuit 3, a speaker frame 5 having the magnetic circuit 3 attached to a rear part thereof, a dome-shaped diaphragm 35 having an edge 33 continuously provided at an outer periphery thereof, and a voice coil 12 which is wound around a voice coil bobbin 11 in a cylindrical shape.

The magnetic circuit 3, speaker frame 5, voice coil bobbin 11, voice coil 12 and so on, among constituent components of the speaker unit 31 are the same as those components of the related art illustrated in FIG. 1. Therefore, they are herein denoted with the same reference numerals, and their detailed explanation will be omitted.

The dome-shaped diaphragm 35 has a dome part 35*a* in a dome-like shape which is convex forward in an oscillating direction of the diaphragm (i.e., the forward direction of sound travel when emitted from a speaker), a neck part 3 Sb which is provided in continuation to an outer periphery of this dome part 35*a* for permitting the voice coil bobbin 11 to be fixed thereto, and an edge 33 having a roll part 33*a* in a curved shape which is convex forward in the oscillating direction. An inner peripheral edge of the roll part 33*a* is continued to the neck part 35*b*.

A flange part 33*b* is extended from an outer peripheral edge of the edge 33. This flange part 33*b* is fixed to an edge supporting part 5*a* in the front of the speaker frame 5, in a state held between the edge supporting part 5*a* and a ring-shaped gasket 21 which is attached to the edge supporting part 5*a*.

The neck part 35*b* is in a shape of a straight tube having a short length so that a distal end of the voice coil bobbin 11 can be engaged therewith.

In case of the dome-shaped diaphragm 35 in this embodiment, a curved portion 39 which is convex backward in the oscillating direction (that is, toward the magnetic circuit 3) is provided so as to extend from the neck part 35*b*, and an outer periphery of this curved portion 39 is smoothly (so as not to be formed as an acutely bent structure) continued to the inner periphery of the roll part 33*a*.

The curved portion 39 continuously provided from the neck part 35*b* has a curved face which has a smaller radius of curvature than a curved face of the roll part 33*a*.

Moreover, curvature of the roll part 33*a* is so determined that an apex P1 of the roll part 33*a* can be lower in height than an apex P2 of the dome part. Accordingly, there is created a difference h in height between the two apexes P1 and P2.

The dome-shaped diaphragm 35 according to the embodiment includes the dome part 35*a* which is formed in a dome-like shape convex forward in the oscillating direction, the neck part 35*b* which is provided in continuation to the outer periphery of the dome part 35*a* for permitting the voice coil bobbin 11 to be fixed thereto, and the edge 33 including the roll part 33*a* which is formed in a curved shape, convex forward in the oscillating direction, and continued to the neck part 35*b* at the inner peripheral edge thereof, and the flange part 33*b* which is provided at the outer peripheral edge of the roll part 33*a* and fixed to the speaker frame, wherein the neck part 35*b* is provided with the curved portion 39 which is convex backward in the oscillating direction, and the outer periphery of the curved portion 39 is continued to the inner periphery of the roll part 33*a*.

Accordingly, the curved portion 39 which is provided continuously from the neck part 35*b* at the outer periphery of the dome part 35*a* has a curved shape which is convex backward in the oscillating direction, contrarily to the roll part 33*a* of the edge 33, and functions to retract its joint position with the inner peripheral edge of the roll part 33*a* of the edge 33 backward in the oscillating direction.

For this reason, a rising height of the roll part 33*a* (a height difference h2 from a bottom of the curved portion 39 to the apex P1 of the roll part 33*a*) can be sufficiently secured without changing a position of the apex P1 of the roll part 33*a* of the edge 33, and in this manner, enhancement of the rigidity of the edge 33 due to an increase in the rising height of the roll part 33*a* can be attained.

In other words, the rising height h2 of the roll part 33*a* can be increased without changing a vertical position of the apex P1 of the roll part 33*a* of the edge 33, and the height difference h between the two apexes P1 and P2 of the roll part 33*a* and the dome part 35*a* can be thus maintained. Therefore, it is possible to prevent the apex of the roll part 33*a* from protruding forward in the oscillating direction, which would cause a sound emitted from the dome part 35*a* to interfere with the roll part 33*a*. In this manner, disturbance of acoustic characteristics due to interference of the sound with the roll part 33*a* can be eliminated, and hence, the rigidity of the edge part 33 can be increased, without sacrificing the acoustic characteristics.

Further, the position of the apex P1 of the roll part 33*a* can be shifted radially outwardly because of presence of the curved portion 39, and a distance L in a horizontal direction between the two apexes P1 and P2 can be increased. This also contributes in preventing the interference of sounds with the roll part 33*a*.

In addition, the curved portion 39 which is provided continuously from the neck part 35*b* at the outer periphery of the dome part 35*a* is smoothly continued to the inner peripheral edge of the roll part 33*a* of the edge 33, and hence, the connecting portion between the neck part 35*b* and the roll part 33*a* is not formed as a bent structure at an acute angle, which would be a cause for a pin hole or rupture.

Therefore, deterioration of the molding performance due to the bent structure at an acute angle and occurrence of concentration of stress during the oscillating action can be prevented. As the results, occurrence of a pin hole due to deterioration of the molding performance and rupture due to concentration of stress can be prevented, and hence, increase in yield of the product and max power input can be achieved.

It is also possible to make the curved portion 39 compact, by setting the radius of curvature of the curved portion 39 smaller than the radius of curvature of the roll part 33*a*, as shown in the above described embodiment.

Still further, it is possible to reliably prevent the sound emitted from the dome part 35*a* from interfering with the roll part 33*a*, by restricting the curvature of the roll part 33*a* so that the apex P1 of the roll part 33*a* can be lower in height than the apex P2 of the dome part 35*a*.

What is claimed is:

1. A dome-shaped diaphragm of a speaker comprising:

a dome part which is formed in a dome-like shape and is convex forward in an oscillating direction that is a forward direction of sound travel when emitted from the speaker;

a neck part connected to an outer periphery of the dome part for fixing a voice coil bobbin thereto; and an edge including a roll part which is formed in a curved shape, convex forward in the oscillating direction, and continued to the neck part at an inner peripheral edge thereof, and a flange part which is provided at an outer peripheral edge of the roll part to be fixed to a speaker frame;

wherein the neck part is provided with a curved portion which is convex backward in the oscillating direction, and an outer periphery of the curved portion is continued to an inner periphery of the roll part, and wherein an inner periphery of the curved portion is connected to an outer face of the voice coil bobbin.

2. The dome-shaped diaphragm according to claim 1, wherein the curved portion of the neck part has a curved face a radius of curvature of which is smaller than that of a curved face of the roll part.

3. The dome-shaped diaphragm according to claim 1, wherein a curvature of the roll part is set so that an apex of the roll part is lower in height than an apex of the dome part.

4. The dome-shaped diaphragm according to claim 1, wherein the curved portion is smoothly connected to the inner periphery of the roll part without forming a corner.

5. A speaker comprising:

a magnetic circuit;

a speaker frame;

a voice coil bobbin having a voice coil wound around the voice coil bobbin, the voice coil bobbin being oscillated by the magnetic circuit; and a diaphragm attached to the voice coil bobbin and the speaker frame, the diaphragm including:

a dome part which is formed in a dome-like shape and is convex forward in an oscillating direction that is a forward direction of sound travel when emitted from the speaker;

a neck part connected to an outer periphery of the dome part for fixing the voice coil bobbin thereto; and an edge including a roll part which is formed in a curved shape, convex forward in the oscillating direction, and continued to the neck part at an inner peripheral edge thereof, and a flange part which is provided at an outer peripheral edge of the roll part to be fixed to the speaker frame;

wherein the neck part is provided with a curved portion which is convex backward in the oscillating direction, and an outer periphery of the curved portion is continued to an inner periphery of the roll, and wherein an inner periphery of the curved portion is connected to an outer face of the voice coil bobbin.

6. A dome-shaped diaphragm comprising:

a dome part which is formed in a dome-like shape and is convex in a first direction;

a neck part connected to an outer periphery of the dome part for fixing a voice coil bobbin thereto; and an edge including a roll part which is formed in a curved shape, is convex in the first direction, and continued to the neck part at an inner peripheral edge thereof, and a flange part which is provided at an outer peripheral edge of the roll part to be fixed to a speaker frame;

wherein the neck part is provided with a curved portion which is convex in a second direction that is opposite to the first direction, and an outer periphery of the curved portion is continued to an inner periphery of the roll part.

* * * * *